US007235024B2

(12) United States Patent
Lefebvre et al.

(10) Patent No.: US 7,235,024 B2
(45) Date of Patent: Jun. 26, 2007

(54) TRAINING BAT

(75) Inventors: James Lefebvre, Scottsdale, AZ (US); James G. Tribble, Winfield, WV (US)

(73) Assignee: West Virginia Bats, LLC, Eleanor, WV (US)

( * ) Notice: Subject to any disclaimer, the term of this patent is extended or adjusted under 35 U.S.C. 154(b) by 0 days.

(21) Appl. No.: 11/166,474

(22) Filed: Jun. 24, 2005

(65) Prior Publication Data

US 2005/0288130 A1 Dec. 29, 2005

Related U.S. Application Data

(60) Provisional application No. 60/582,965, filed on Jun. 24, 2004.

(51) Int. Cl.
*A63B 69/00* (2006.01)

(52) U.S. Cl. ..... 473/457; 473/564

(58) Field of Classification Search ..... 463/47.1, 463/47.2–47.7; 473/422, 437, 457, 564–568, 473/519, 526, 538

See application file for complete search history.

(56) References Cited

U.S. PATENT DOCUMENTS 537,927 A * 4/1895 Kennedy ..... 473/520
1,509,733 A 9/1924 Langford
3,246,894 A * 4/1966 Salisbury ..... 473/457
3,679,205 A * 7/1972 Finkle et al. ..... 473/463
3,877,698 A 4/1975 Volpe
3,937,468 A 2/1976 Conde, Sr.
4,000,895 A 1/1977 Scott, Jr. et al.
4,017,073 A 4/1977 Dolan
4,023,803 A 5/1977 Lewis
4,132,408 A 1/1979 Sabat
4,155,551 A 5/1979 Smith
4,213,607 A 7/1980 Fujii
4,249,729 A * 2/1981 Gabrielidis ..... 473/464
4,399,996 A 8/1983 Boyce
4,492,377 A * 1/1985 Eby ..... 463/47.2
4,555,111 A * 11/1985 Alvarez ..... 473/457
4,682,773 A 7/1987 Pomilia
4,714,251 A 12/1987 Cook
4,763,899 A 8/1988 Hundley
4,768,785 A 9/1988 Patterson (Continued)

OTHER PUBLICATIONS

Advertisement for Easton Baseball Bats (6 website paged dated Aug. 15, 2002).

(Continued)

*Primary Examiner*—Mitra Aryanpour
(74) *Attorney, Agent, or Firm*—Thompson Hine LLP

(57) ABSTRACT

A training bat having a handle portion with a knob end and a barrel receiving end, a hitting portion, and a means for tethering said handle portion to said hitting portion. The means for tethering is selected from either an eye bolt assembly, a link assembly, and an eye bolt. The eye bolt assembly joins a wood fitting portion secured within the barrel receiving end of the handle portion to the hitting portion by one or more chain links, as well as joins a wood hitting portion to the one or more chain links. The link assembly joins a plug secured within the barrel receiving end of the handle portion to the hitting portion by one or more chain links.

24 Claims, 10 Drawing Sheets

U.S. PATENT DOCUMENTS

| | | | | |
|---|---|---|---|---|
| 4,854,585 | A | 8/1989 | Koch et al. | |
| 5,409,214 | A | 4/1995 | Cook | |
| 5,489,100 | A | 2/1996 | Potter | |
| 5,516,097 | A * | 5/1996 | Huddleston | 473/457 |
| 5,524,886 | A | 6/1996 | Kim | |
| 5,593,158 | A | 1/1997 | Filice et al. | |
| 5,599,021 | A * | 2/1997 | Lary et al. | 473/219 |
| 5,842,808 | A | 12/1998 | Potter et al. | |
| 5,893,800 | A * | 4/1999 | Taggart | 463/47.5 |
| 6,126,292 | A * | 10/2000 | Liu | 362/102 |
| 6,241,629 | B1 * | 6/2001 | Otto | 473/457 |
| 6,398,652 | B1 | 6/2002 | Schweizer et al. | |
| 6,432,006 | B1 | 8/2002 | Tribble | |
| 6,558,267 | B2 | 5/2003 | Novosel, Sr. | |
| 6,561,930 | B2 | 5/2003 | Mabry | |
| 6,565,462 | B1 | 5/2003 | Gregg | |
| 6,569,042 | B2 | 5/2003 | LaChance et al. | |
| 6,572,497 | B1 | 6/2003 | Halsworth | |
| 6,609,984 | B1 | 8/2003 | Tribble | |
| 6,758,771 | B2 | 7/2004 | Tribble | |
| 6,770,002 | B2 | 8/2004 | Aigotti | |
| 7,086,951 | B2 * | 8/2006 | Chang | 463/47.5 |
| 2004/0162167 | A1 * | 8/2004 | Stevens et al. | 473/457 |

OTHER PUBLICATIONS

Advertisement for Nunchukas (6 website pages dated Aug. 20, 2005).

* cited by examiner

TRAINING BAT

CROSS-REFERENCE TO RELATED APPLICATIONS

This application claims the benefit of U.S. Application No. 60/582,965, filed Jun. 24, 2004.

BACKGROUND OF THE INVENTION

1. Technical Field

This invention relates to bats and the art of training devices, and in particular, to training bats used for training a user's bat swing. The present invention has a hitting portion and a handle portion with a tethered means for connecting the hitting portion to the handle portion such that the hitting portion is pivotally tethered to the handle portion, resulting in the training bat moving between an angled position and an extended position.

2. Related Art

There are a number of bat training devices for assisting a user with improving his/her swing of a baseball or softball bat. The majority of such training devices are separate devices intended to be used with a conventional baseball or softball bat. However, there are certain training devices directed to a modified bat which are designed to correct and improve a user's batting swing style.

In U.S. Pat. No. 4,399,996 to Boyce, a Practice Bat is disclosed having a spring connecting a hand portion with a head portion with the spring positioned just above the knob of the handle. A user places one hand below the spring and one hand above the spring when using the bat. The bat is designed for assisting the user to break his wrists during the follow-through of a swing. A disadvantage of this practice bat is that it is very awkward to use because a user employs an unnatural grip, with his/her hands separated, on the bat handle when training. Therefore, there is a need for a training bat that allows a user to have a conventional grasp of the bat, with hands together on the handle, when practicing his/her swing.

Similarly, in U.S. Pat. No. 6,569,042 to LaChance, et al., a Sports Swing Development Device is disclosed which also has a spring to connect a head portion with a handle portion, but this spring is positioned closer to the head portion. The type of spring used in this device is a tightly wound coil spring such that the head portion and the handle portion remain along the same longitudinal axis even when not in use. That is, the head portion does not at any time drop down and rest at an angle less than about 180 degrees from the handle portion. A disadvantage of this practice bat is that it does not provide any immediate visual feedback to the user of whether or not he/she has swung the bat properly because the practice bat remains in an extended position as conventional bats.

Therefore, there is a need for a training bat in which a head portion is tethered to a handle portion such that the head portion is freely pivotable in any direction about the handle portion. There is a further need for such a training bat such that in use, the user is immediately given visual feedback as to whether he/she has achieved a proper swing with the head portion moving from an angled position in relation to a handle portion into an extended position wherein the head portion is aligned along the same longitudinal axis as the handle portion.

Furthermore, there are no bats available wherein a bat is separated into two distinct portions—a hitting portion and a handle portion such that the hitting portion is tethered to the handle portion such that both portions move independent of each other with free range of motion.

Similar to bat swing training devices, there are a number of modified golf clubs that are designed to assist a user in improving his/her golf swing. For example, U.S. Pat. Nos. 4,854,585; 5,489,100; 5,842,808; and 6,558,267 disclose various golf clubs each of which has a head portion that pivots during a swing such that upon contacting the golf ball, the head portion is in the proper hitting position so long as the user made a proper swing. In these devices, the head portion only pivots in one plane. That is, the hinge connecting the head portion to the shaft is designed for the head portion to pivot back and forth in a single direction. This limitation is required for a training golf club because unlike a baseball bat, a golf club has one very specific planar club face for hitting a ball.

Therefore, there is a need for a swing aid in which the hitting portion freely pivots about the handle portion and is not limited to one specific plane of motion.

In the field of karate, the nunchuka weapon is a pair of sticks connected together by a short chain. The sticks are the same length, size and shape wherein they are typically tapered from a thicker handle end to a thinner distal end connected to the chain between the handles. Also, the sticks are less than about one inch in diameter, and they are typically separated by about 3–7 inches of chain. Although the nunchukas are useful as a karate weapon, the nunchukas are not very useful in training a user's swing to hit a ball. The sticks are to small to be effective, and the separation distance between the sticks provides too much freedom of movement of the sticks.

Therefore, there is a need for a bat swing aid in which a hitting portion is tethered to a handle portion by a distance that provides an optimum degree of movement between the two portions. There also is a need for such a bat swing aid wherein the two portions of the bat when viewed in combination with the tether resemble the overall length, size, and shape of a conventional baseball/softball bat.

SUMMARY OF THE INVENTION

The training bat of the present invention solves the problems associated with conventional training bats and devices, as well as methods, for training a user's bat swing. In the preferred embodiment, the training bat has a wood hitting portion and a metal handle portion. A link assembly fits within the barrel receiving end of the metal handle portion and is tethered to the wood hitting portion by a single chain link.

In one embodiment, a training bat is manufactured from a metalwood bat described in U.S. Pat. Nos. 6,758,771 and 6,824,482, and then the hitting portion of the wood barrel portion is separated from the metalwood bat, resulting in the fitting portion of the wood barrel portion remaining secured within the metal handle portion to create a modified metal handle portion. Once separated, a predefined length is further removed from the hitting portion resulting in a modified hitting portion, which for convenience purposes, may, at times, be referred to as the modified hitting portion or simply the hitting portion. The modified hitting potion is secured to the fitting portion secured within the modified metal handle portion by a means for tethering the modified hitting portion to the modified metal handle portion. The resulting training bat has the overall look, length, weight and shape of a conventional baseball/softball bat. Thus, the predefined length of the hitting portion removed is that length about equal to the tethered distance between the modified handle portion and the modified hitting portion wherein the overall length of the training bat is about equal to a conventional bat.

In alternative embodiments, the training bat is still the hitting portion tethered to the handle portion, but both the hitting portion and the handle portion are the same material—both metal or both wood. If both portions are metal, then two link assemblies are used with a first link assembly in the end of the handle portion and a second link assembly in the end of the hitting portion. The two link assemblies are then tethered by a single chain link. If both portions are wood, then a first eye hook is secured to the end of the handle portion and a second eye hook is secured to the end of the hitting portion. Again, a single chain link is used to tether the handle portion to the hitting portion.

In operation, the training bat of the present invention is very easy to use. A user simply holds the handle end and swings at a pitched, or stationary, ball. If the user swings with the proper form and speed, the hitting portion extends out such that the training bat is in a fully extended position with the central longitudinal axis of the hitting portion being aligned along the central longitudinal axis of the handle portion. This extended position creates an appearance visually similar to a conventional bat. If the user swings with an improper form or without the proper bat swing speed, the hitting portion does not extend fully, but rather will swing at an angle such that the longitudinal axis of the handle portion is at an angle less than 180 degrees with the longitudinal axis of the hitting portion. When the bat is in this angled position, the user will either not hit the ball at all, or not hit the ball well resulting in the hit ball not traveling very far or in the desired direction.

There are several important advantages to the training bat of the present invention. First, when in an extended position, the training bat has the shape, length, overall weight, and weight distribution of a conventional baseball/softball bat. This facilitates a user's transition between the training bat and a conventional bat. Second, in the preferred embodiments, the training bat has a wood hitting portion, thereby maintaining the traditional aspects of the game. Third, the training bat is very simple to use with no complicated parts or instruction. When the user swings with proper form, the hitting portion extends into the proper extended position, allowing the user to hit the ball with maximum power. This use and operation of the training bat is very intuitive. Also, the training bat provides immediate visual feedback to the user as well as the observing trainer as to whether the user swung properly.

DESCRIPTION OF THE FIGURES

The present invention is described with reference to the accompanying drawings. In the drawings, like reference numbers indicate identical or functionally similar elements. Additionally, the left-most digit(s) of a reference number identifies the drawings in which the reference number first appears.

DETAILED DESCRIPTION OF THE PREFERRED EMBODIMENTS

Figure 7A:
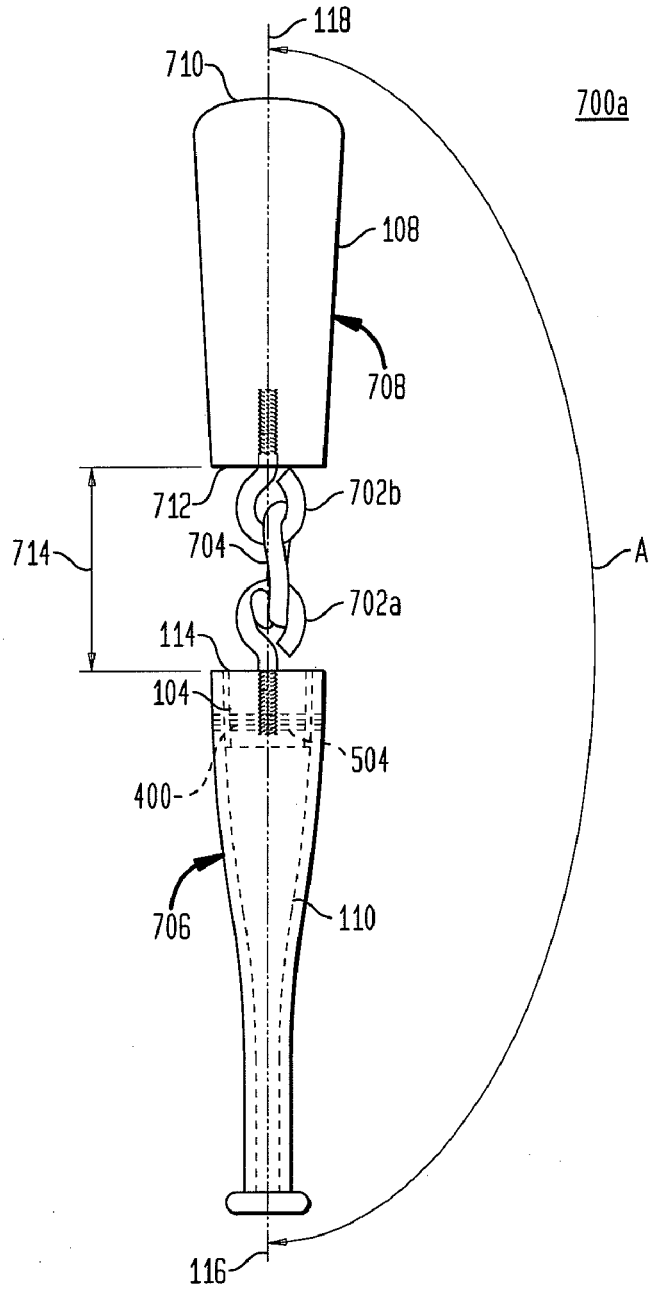
FIG. 7*a:* A planar side view of a training bat of the present invention in an extended position.
Figure 7B:
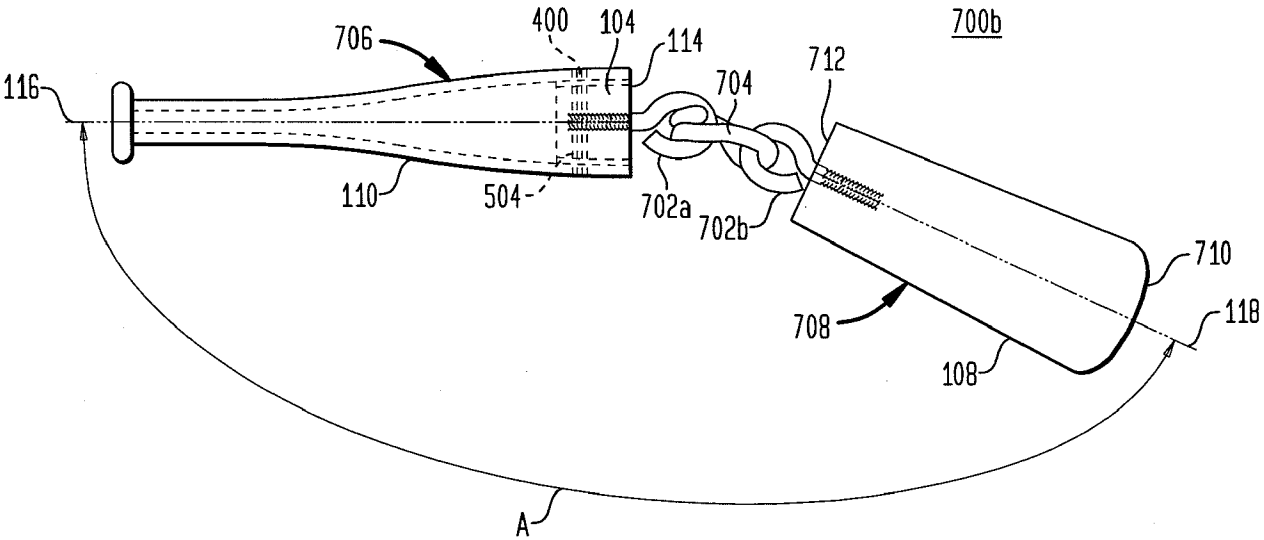
FIG. 7*b:* A planar side view of the training bat in an angled position.

The training bat 700*a* and 700*b* (hereinafter referred to collectively as training bat 700) of the present invention is shown in the fully extended position 700*a* in FIG. 7*a* and in an angled position 700*b* in FIG. 7*b*. In its preferred embodiment, the training bat 700 is a combination metal and wood bat wherein the hitting portion 108 of the training bat 700 is wood while the handle portion 110 is metal.

In one embodiment, a training bat 700 originates as a metalwood bat 100 manufactured according to the method and apparatus description as provided in U.S. Pat. Nos. 6,758,771 and 6,824,482, titled "Metal Wood Bat Connection Assembly," issued Jul. 6, 2004 and Nov. 30, 2004 respectively, which are incorporated herein by reference in their entirety. In this embodiment, a metalwood bat 100 is manufactured as described therein and below, with the exception of the exterior sleeve 200 which is not needed with a training bat 700. Once manufactured, the hitting portion 108 of the wood barrel portion 102 is separated from the metalwood bat 100, resulting in the fitting portion 104 of the wood barrel portion 102 remaining secured within the barrel receiving end 114 of the handle portion 110 to create a modified handle portion 706. The preferred means for separating the metalwood bat 100 into two pieces is simply cutting, or sawing, the wood hitting portion 108 at the seam 502 by conventional means, such as a table saw.

Once separated, a predefined length is further removed from the hitting portion 108 resulting in a modified hitting portion 708 having a first end 710 and a second end 712. For convenience, the terms modified hitting portion 708 may at times be referred to as hitting portion 708. The length of the hitting portion 108 removed is that length about equal to the final tethered distance 714 between the modified hitting portion 708 and the modified handle portion 706 such that the final length of the training bat 700 is about equal to a conventional baseball/softball bat.

Metalwood Bat

The connection assembly for a metalwood bat 100 is shown in FIGS. 1–6. The metalwood bat 100 comprises a wood barrel portion 102, having a central longitudinal axis 118, and a metal handle portion 110, having a central longitudinal axis 116. The wood barrel portion 102 is designed and manufactured according to conventional wood bat methods. In the preferred embodiment, the metal handle portion 110 is a hollow piece of metal, e.g., aluminum or graphite, manufactured using well known techniques, and having a barrel receiving end 114 and a knob end 112 at its distal end. The wood barrel portion 102 and the metal handle portion 110 are such that the total size, weight, and weight distribution of the metalwood bat 100 of the present invention are identical to those of conventional bats. Once the metalwood bat 100 is manufactured, a batter may place any conventional type of grip on the metal handle portion 110 for comfort and improvement of his/her batting.

In the preferred embodiment, the wood barrel portion 102 of the metalwood bat 100 has a hitting portion 108 and a fitting portion 104. The hitting portion 108 is the exposed area of the metalwood bat 100 for hitting a ball, and the fitting portion 104 is that part of the wood barrel portion 102 for interlocking with the metal handle portion 110. In the preferred embodiment, the fitting portion 104 tapers from a first diameter of about 1⅝ (1.625) inches to a second diameter of about 0.985 inches and is about 3 inches in length. The tapering diameter of the fitting portion 104 is recessed about ⅛ of an inch smaller than the diameter of the hitting portion 108 to ensure its fit within the metal handle portion 110. The taper of the fitting portion 104 is about equal to the angle of taper of the barrel receiving end 114 of the metal handle portion 110.

The connection assembly is used to secure the metal handle portion 110 of a metalwood bat 100 to the wood barrel portion 102 of the bat 100, wherein the fitting portion 104 of the wood barrel portion 102 fits and is secured within the barrel receiving end 114 of the metal handle portion 110. The connection assembly assures that the wood barrel portion 102 does not separate from the metal handle portion 110 as well as dampens any vibration that may result from the interconnection between a metal handle portion 110 and a wood barrel portion 102.

The hitting portion 108 of the wood barrel portion 102 is shaped as with a conventional wooden bat. The fitting portion 104 of the wood barrel portion 102 is a smaller tapered portion of the wood barrel portion 102 that is sized to fit within the barrel receiving end 114 of the metal handle portion 110. The transition 106 between the hitting portion 108 and the fitting portion 104 is a smooth taper, e.g., 45 degrees, that gradually and smoothly slopes from the diameter of the hitting portion 108 to the top of the fitting portion 104. The edges of the transition 106 are also smoothed and rounded.

In the preferred embodiment, the connection assembly of the present invention optionally comprises three components: an exterior sleeve 200, an interior sleeve 300, and/or a pin assembly, e.g., a locking pin 400 or a roll pin assembly 600. The interior sleeve 300 is an elongated, cone shaped, rubber tube having an outer surface 302 and an inner suffer 304 that tapers from a top opening 306 to a bottom opening 308 such that the diameter of the top opening 306 is larger than the diameter of the bottom opening 308. In the preferred embodiment, the interior sleeve 300 is about three inches in length and is made from about 1/16 of an inch thick rubber, e.g., 40 durometer gum rubber. A tacky, gum rubber is preferred because of its natural adhesion properties, thereby eliminating the need for an adhesive. The length, top opening 306 and bottom opening 308 of the interior sleeve 300 are sized such that the fitting portion 104 of the wood barrel portion 102 fits snuggly within the interior sleeve 300.

Once the interior sleeve 300 is placed over the fitting portion 104 of the wood barrel portion 102, the fitting portion 104 with the interior sleeve 300 is pressure fit within the barrel receiving end 114 of the metal handle portion 110, thereby creating a seam 502 between the wood barrel portion 102 and the metal handle portion 110. Preferably the fitting portion 104 is inserted into the barrel receiving end 114 such that the top opening 306 of the interior sleeve 300 is slightly below the seam 502.

A hole 504 is drilled through the metal handle portion 110, the interior sleeve 300 and the fitting portion 104 about one half of an inch below the seam 502. The hole 504 is traverse to the longitudinal axis of the metalwood bat 100 and preferably passes through the center of the metalwood bat 100.

Figure 1:
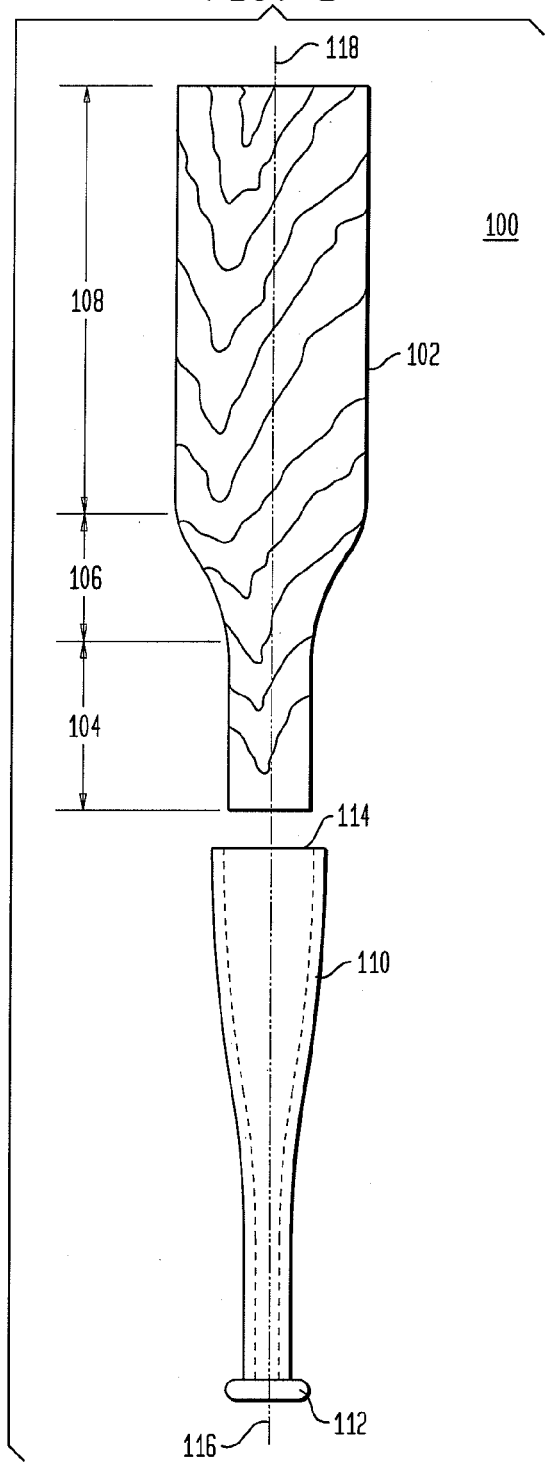
FIG. 1: A planar side view of a wood barrel portion and a metal handle portion of a metalwood bat.
Figure 2:
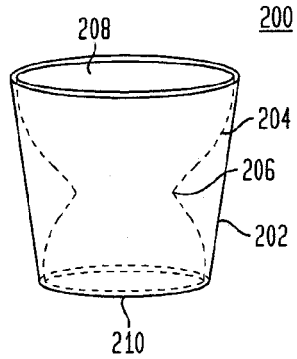
FIG. 2: A perspective view of an exterior barrel sleeve.
Figure 3:
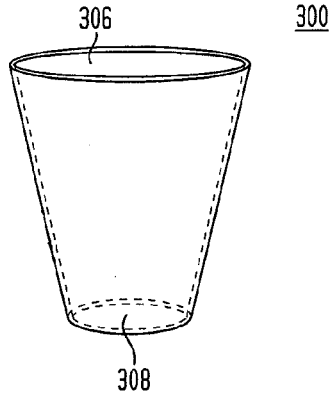
FIG. 3: A perspective view of an interior barrel sleeve.
Figure 4:
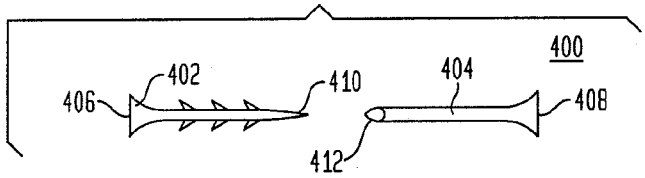
FIG. 4: A perspective view of a locking pin.
Figure 5:
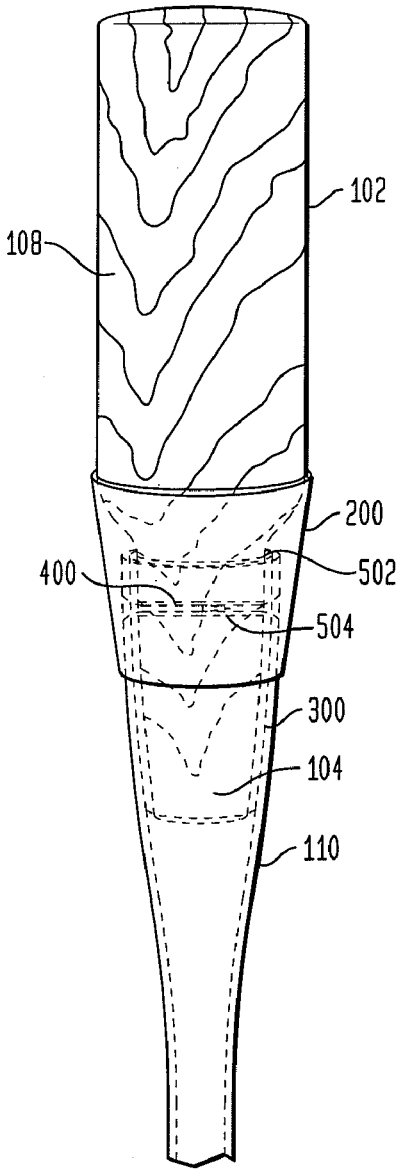
FIG. 5: A perspective view of a metalwood bat.
Figure 6:
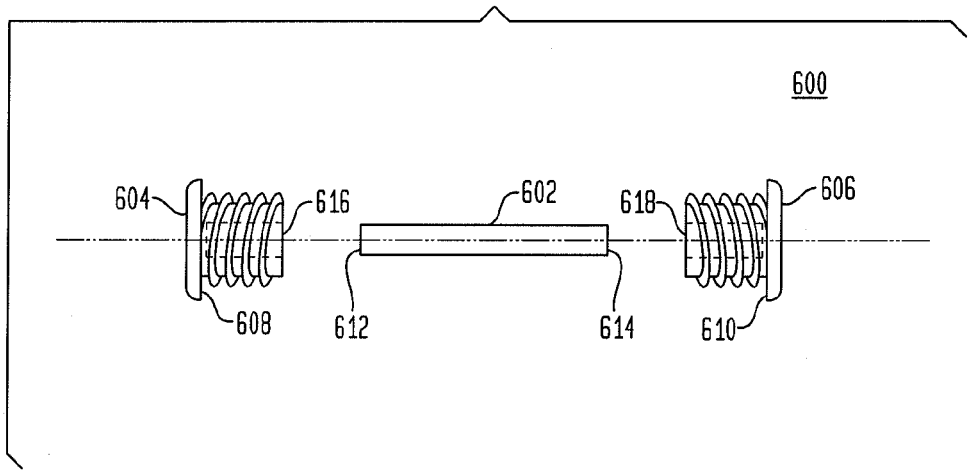
FIG. 6: A planar cross-sectional view of an alternative means for securing a metal handle portion to a wood barrel portion.

In one embodiment of a pin assembly, a locking pin 400 is used to secure the metal handle portion 110 to the wood barrel portion 102, passing through the metal handle portion 110, the interior sleeve 300, and the fitting portion 104 of the wood barrel portion 102. The preferred embodiment of the locking pin 400 is shown in FIG. 4, wherein the locking pin 400 is a commercially available stainless steel press fit pin, about ⅛ of an inch by about 1½ inches, having a male component 402 and a female component 404. In operation, the male component 402 is pressure fit, pointed end 410 first, into the opening 412 of the female component 404 such that they are locked together. The male component 402 is also preferably serrated in order to achieve a tighter and more secure lock within the female component 404. In addition, both the head end 406 of the male component 402 and the head end 408 of the female component 404 are flat surfaces that are wider in diameter than the shaft of the female component 404.

In operation, the female component 404 is inserted into one side of the hole 504 in the bat 100 until the head end 408 of the female component 404 is flush with, or approximately flush with, the exterior surface of the metal handle portion 110. The male component 402 is inserted into the opposite side of the hole 504 and pressure fit within the female component 404 until the head end 406 of the male component 402 is flush with, or approximately flush with, the exterior surface of the metal handle portion 110.

In an alternative pin assembly, another type of pin is used to lock the metal handle portion 110 to the wood barrel portion 102 of the metalwood bat 100. In this embodiment, a roll pin 602, about 5/32 of an inch in diameter and about the length of the hole 504, is inserted into the hole 504. Then, a threaded cap screw 604, 606, such as a ½ inch, flat, cap screw, is driven into each open end of the hole 504 such that each end 612, 614 of the roll pin 602 is driven into a cavity 616, 618 of a threaded cap screw 604, 606, resulting in wedging the roll pin 602 into the hole 504 such that it cannot loosen, or otherwise fall out of the hole 504. A threaded cap screw 604, 606 is preferred because the threading on the exterior surface assists in preventing the threaded cap screws 604, 606 from falling out. Once the two threaded cap screws 604, 606 are in place, the heads 608, 610 of the threaded cap screws 604, 606 are grinded, or ground, off by conventional grinding means. The use of the two threaded cap screws 604, 606 to secure the roll pin 602 into the hole 504 acts the same as heat welding or tack welding the ends 612, 614 of the roll pin 602. The use of a roll pin 602 and threaded cap screws 604, 606 are for convenience purpose only. It would be readily apparent to one of ordinary skill in the relevant art to use a comparable fastener, e.g., a metal rod and rivets, grommets, or washers.

Once a pin assembly, e.g. locking pin 400 or roll pin assembly 600, is installed within the bat 100, the exterior sleeve 200 is applied to the bat 100. In the preferred embodiment, the exterior sleeve 200 is a rubber elastomer, being an elongated cone-shaped tube of about 1½ to 3½ inches in length and having an exterior surface 202, an interior surface 204, a top opening 208 and a bottom opening 210. Similar to the interior sleeve 300, the exterior sleeve 200 tapers from the top opening 208 to the bottom opening 210 resulting in the top opening 208 having a diameter greater than the bottom opening 210. The contour of the interior surface 204 of the exterior sleeve 200 is approximate to the contour of the exterior surface of the seam 502 and the transition 106 between the wood barrel portion 102 and the metal handle portion 110, which in the preferred embodiment is generally "hour glass" shaped having an indent 206 at the position of the seam 502. The exterior surface 202 is generally smooth and straight in shape. Also in the preferred embodiment, the exterior sleeve 200 is preferably made of a hard, durable rubber, e.g., a urethane 60 durometer rubber such as liquid Flexane commercially available by Devcon.

In operation, the metalwood bat 100 is inserted through the exterior sleeve 200, knob end 112 first through the top opening 208, such that the top opening 208 is in contact with the wood barrel portion 102, the bottom opening 210 is in contact with the metal handle portion 110, and the seam 502 between the wood barrel portion 102 and the metal handle portion 110 is about centered at the dent 206 in the interior surface 204 of the exterior sleeve 200. The exterior sleeve 200 must be long enough in length such that it covers and extends beyond the pin assembly, e.g., the locking pin 400 or roll pin assembly 600.

Training Bat

In one embodiment, the metalwood bat 100 is manufactured without an exterior sleeve 200. The hitting portion 108 of the wood barrel portion 102 is separated from the metalwood bat 100, resulting in the fitting portion 104 of the wood barrel portion 102 remaining secured within the barrel receiving end 114 of the handle portion 110. This creates a modified handle portion 706. Also, the preferred means for separating the metalwood bat 100 is by cutting the wood barrel portion 102 at the seam 502 using conventional cutting methods, such as, a table saw. Once separated, a predefined length is further removed from the hitting portion 108 wherein the removed section is taken from the end of the hitting portion 108 cut at the seam 502. This creates a modified hitting portion (or hitting portion) 708 having a first end 710 and a second end 712. Also, the length of the hitting portion 108 removed is about equal to the tethered distance 714 such that the overall length of the training bat 700 is about equal to the length of a conventional baseball/softball bat as well as the metalwood bat 100.

Once separated, the modified hitting portion 708 is secured to the fitting portion 104 secured within the modified handle portion 706 by a means for tethering the modified hitting portion 708 to the modified handle portion 706, thereby creating training bat 700. The means for tethering results in the modified hitting portion 708 being separated from the modified handle portion 706 by a tethered distance 714.

Figure 8:
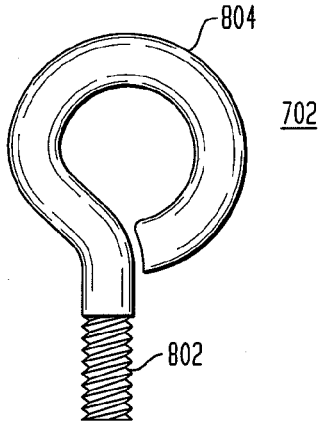
FIG. 8: A perspective view of an eye bolt.
Figure 9:
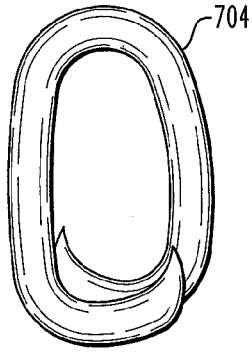
FIG. 9: A perspective view of a chain link.

In this embodiment, the tethering means incudes one or more chain links 704 with a first means for securing a second end 712 of the modified hitting portion 708 with the chain link 704 and a second means for securing the fitting portion 104 in the barrel receiving end 114 of the modified handle portion 706 with the chain link 704. The preferred second means for securing is a first eye bolt 702*a* secured in the fitting portion 104 within the barrel receiving end 114 of the modified handle portion 706. The first means for securing is a second eye bolt 702*b* secured in the second end 712 of the modified hitting portion 708. Hereafter, the first eye bolt 702*a* and second eye bolt 702*b* may be referenced as eye bolt 702 as depicted in FIG. 8. FIGS. 7*a,b* show the use of one chain link 704 for convenience only. It would be readily apparent to one of ordinary skill in the relevant art to use a plurality of chain links 704 as needed based on the size of the chain links 704 and the desired tethered distance 714 between the modified hitting portion 708 and the modified handle portion 706 (which in turn determines the overall length of the training bat 700).

To secure the first eye bolt 702*a* in the fitting portion 104, an eye bolt assembly is used. In an eye bolt assembly, a hole is bored into the fitting portion 104 about the diameter and length of the threaded portion 802 of the first eye bolt 702*a*. The threaded portion 802 of the first eye bolt 702*a* is either a length that terminates at a point before the hole 504 and pin 400 or is a length such that the threaded portion 802 extends beyond the hole 504 and pin 400. In this second embodiment, the hole 504 and pin 400 preferably passes through the center of the threaded portion 802 of the first eye bolt 702*a* to further secure the first eye bolt 702*a* in the fitting portion 104. However, to accomplish this design, the hole 504 and pin 400 must be installed after the first eye bolt 702*a* is secured to the fitting portion 104. Alternatively, an adhesive or liquid nails or similar compound can be used to secure the first eye bolt 702*a* in a hole in the fitting portion 104.

To secure the second eye bolt 702*b* in the modified hitting portion 708, a hole is bored into the second end 712 of the modified hitting portion 708 about the diameter and length of the threaded portion 802 of the second eye bolt 702*b*. The threaded portion 802 of the second eye bolt 702*b* is then screwed into the hole. Alternatively, an adhesive, liquid nails, liquid epoxy, or similar compound can be used to secure the second eye bolt 702*b* in the second end 712 of the modified hitting portion 708.

Figure 12:
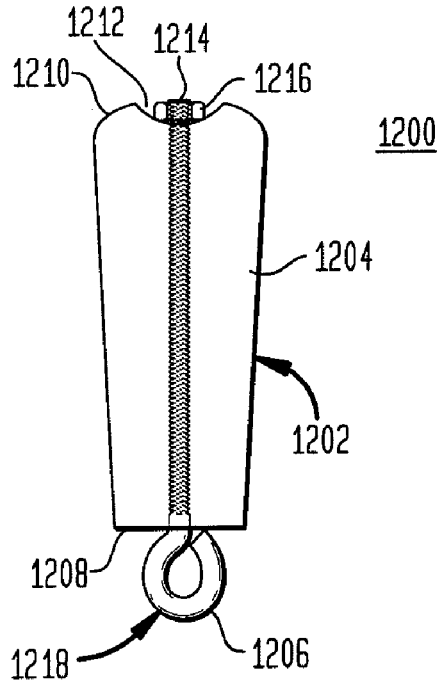
FIG. 12: A planar side view of an alternative embodiment of the wood hitting portion of the present invention.

An alternative means for securing the modified hitting portion 708 to the chain link 704 is shown in FIG. 12. In this embodiment, the wood hitting portion 1204 of an alternative modified hitting portion 1202 has the same overall length, shape, and dimensions as the modified hitting portion 708. However, the eye bolt 1218 herein is about 12 inches in length and is inserted through the modified hitting portion 1202 along its central longitudinal axis such that the loop 1206 is in contact with a first end 1208 of the modified hitting portion 1202 and the threaded end 1214 of the eye bolt 1218 extends beyond the modified hitting portion 1202. Also in this embodiment, the second end 1210 of the modified hitting portion 1202 has a concave depression 1212 such that the threaded end 1214 of the eye bolt 1218, with a nut 1216 for securing the eye bolt 1218, is centrally positioned and contained therein with the threaded end 1214 not extending beyond the second end 1210 of the modified hitting portion 1202.

Once the first eye bolt 702*a* and the second eye bolt 702*b* are installed, the respective loops 804 of each eye bolt 702 are joined together by a chain link 704 using conventional means. In the preferred embodiment, the modified hitting portion 708 is separated from the modified handle portion by a tethered distance 714 of about 3–4 inches. For example, using a 33 inch total bat length, the modified hitting portion 708 is about 11½ inches in length, the modified handle portion 706 is about 18 inches in length, and the tethered distance 714 is about 3½ inches in length. In this embodiment, the modified hitting portion 708 is about 35% of the total bat length, the modified handle portion 706 is about 54.5% of the total bat length, and the tethered distance 714 is about 10.5% of the total bat length.

The preferred method for manufacturing a training bat 700 described above, making modifications to a metalwood bat 100, is for convenience. It would readily be apparent to one of ordinary skill in the art to make the modified handle portion 706 and modified hitting portion (or hitting portion) 708 separately as two individual pieces and then join them together.

Figure 10:
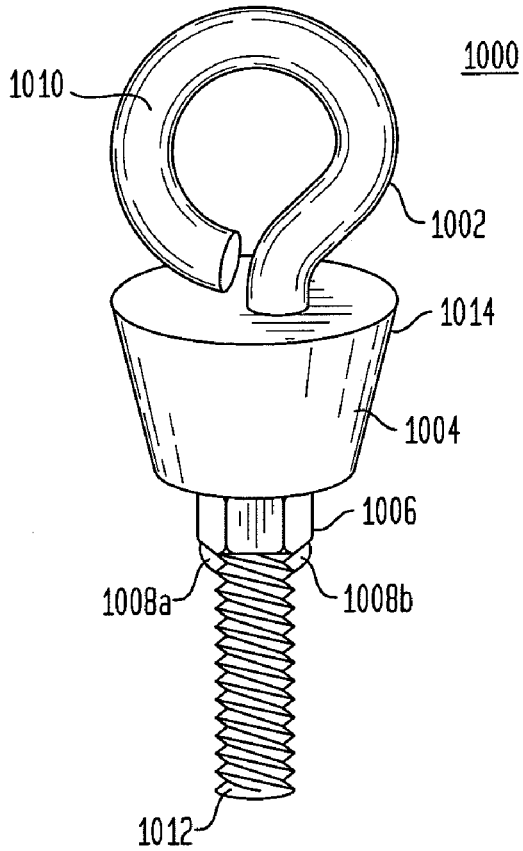
FIG. 10: A perspective view of a link assembly.
Figure 11:
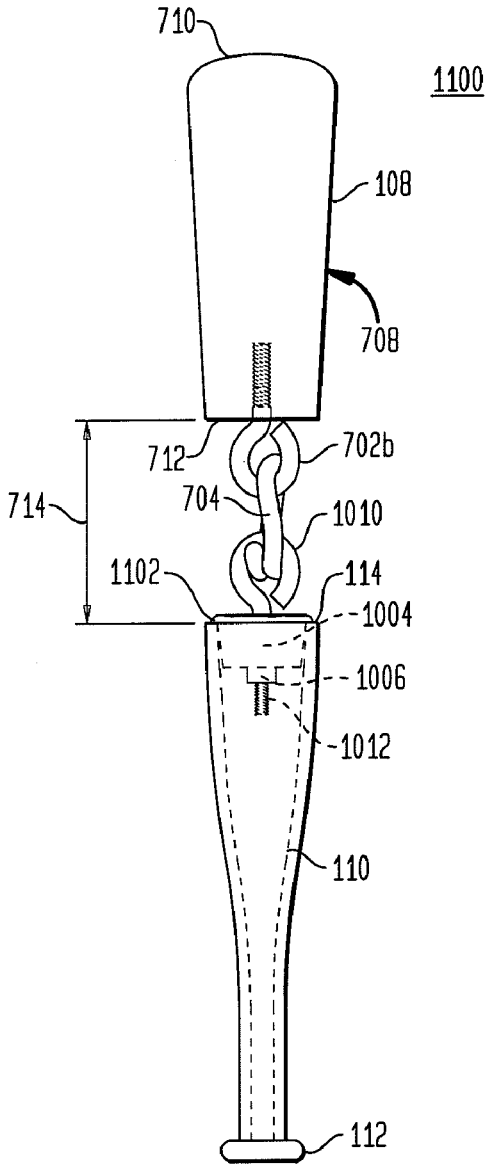
FIG. 11: A planar side view of an alternative training bat of the present invention using the link assembly.

An alternative training bat 1100 is shown in FIGS. 10 and 11 wherein a link assembly 1000 is used in connecting the modified hitting portion 708 to a handle portion 110. In this embodiment, the link assembly 1000 is comprised of a cylindrical plug 1004 having a generally trapezoidal longitudinal cross section, an eye hook 1002 having a loop 1010 and a threaded portion 1012, and a means for securing the eye hook 1002 to the plug 1004. The plug 1004 is of a shape and size such that it can be inserted, with a snug fit, into the barrel receiving end 114 of a handle portion 110 wherein a portion of the top end 1014 of the plug 1004 protrudes above the barrel receiving end 114 of the handle portion 110. For example, in the preferred embodiment, about 3/16 of an inch of the top end 1014 of the plug 1004 extends out of the handle portion 110 when the plug 1004 is pressure fit within the barrel receiving end 114. The preferred plug 1004 is preferably solid metal having a top diameter of about 1½ inches, and a bottom diameter of about 1⅜ inches, but the use of a solid plug is for convenience only. The plug 1004 can be either solid or hollow, but a solid plug 1004 provides a stronger and more secure connection for the training bat 1100. In addition, the plug 1004 may be made of a material selected from the group consisting of: metal, wood, and a composite material. Also, the link assembly 1000 is manufactured with a portion of the top end 1014 of the plug 1004 extending above the barrel receiving end 114 for convenience purpose. It would be readily apparent to one of ordinary skill in the art to design a link assembly 1000 with the top surface of the plug 1004 being about even with the barrel receiving end 114 when installed within the handle portion 110.

The eye hook 1002 is secured to the plug 1004 by passing the threaded portion 1012 of the eye hook 1002 through a hole centrally bored in the plug 1004 and then using a nut 1006 to lock the eye hook 1002 and plug 1004 together. Also, the nut 1006 is further secured by using a liquid epoxy in the hole and by tack welding 1008*a,b* the threaded portion 1012 to the nut 1006 at one or more locations. The nut 1006 is used for convenience purpose only. It would be readily apparent to use another type of fastener such as a cotter pin or other type of locking pin passing through the threaded portion 1012 under the bottom of the plug 1004. In the preferred embodiment, the eye hook 1002 has a loop 1010 having an about two inch outer diameter and a threaded portion 1012 about four inches in length.

The means for securing the eye hook 1002 to the plug 1004 is both pressure fitting the plug 1004 within the barrel receiving end 114 of the handle portion 110 as well as tack welding 1102 the seam between the barrel receiving end 114 and the top end 1014 of the plug 1004 extending above the handle portion 110. Tack welding is the preferred means for securing a metal plug 1004 to the handle portion 110; however, this is for convenience. Depending on the material of the plug 1004 other means for securing the plug 1004 may be appropriate, e.g., glue, an adhesive, epoxy, liquid nails, and the like. Also, a pin 400 may be used, as described in relation to the modified handle portion 706 for securing a wood fitting portion 104 in the modified handle portion 706, to secure the plug 1004 in the handle portion 110.

Once the link assembly 1000 is secured within the handle portion 110, the loop 1010 is attached to the modified hitting portion 708 in the same manner described above using one or more chain links 704.

Furthermore, the preferred training bat 700, 1100 is disclosed as having a wood hitting portion and a metal handle portion, but this is for convenience. It would be readily apparent to one of ordinary skill in the relevant art to use the features of the present invention to design and manufacture a training bat having a metal hitting portion and a metal handle portion, as well as, a wood hitting portion and a wood handle portion. In an embodiment having a metal hitting portion, a link assembly 1000 as described above is used to secure the second end 712 of the metal hitting portion to the chain link 704 wherein the link assembly 1000 is inserted into a hollow end of the metal hitting portion. Therefore, when manufacturing a training bat 700, 1100, a link assembly 1000 is used to secure a metal portion (either a metal handle portion 706 or a metal hitting portion) to a chain link 704, or alternatively, an eye bolt 702, 1200 or an eye bolt assembly having an eye bolt 702 is used to secure a wood portion (either a wood handle portion or a wood hitting portion 708) to a chain link 704.

In operation, when waiting for a pitch a user simply holds the training bat 700, 1100 as he/she would hold a conventional bat. The training bat 700, 1100 is in an angled position 700*b* wherein a central longitudinal axis 118 of the modified hitting portion 708 is at an angle "A" less than 180 degrees from a central longitudinal axis 116 of the modified hitting portion 706. A training bat 700 in an angled position 700*b* is shown in FIG. 7*b*. Upon receiving a pitched ball, the user swings the training bat 700, 1100. If the user swings the training bat 700, 1100 with the proper speed and form, the modified hitting portion 708 swings out and away from the modified handle portion 706 such that the central longitudinal axis 118 of the modified hitting portion 708 is aligned with the central longitudinal axis 116 of the modified hitting portion 706, resulting in angle "A" being either about 0 or about 180 degrees. A training bat 700 in an extended position 700*a* is shown in FIG. 7*a*. If the user does not swing the training bat 700, 1100 with either the proper speed or form, the training bat 700, 1100 will not be in an extended position and the central longitudinal axis 118 of the modified hitting portion 708 will be at some angle less than 180 degrees from the central longitudinal axis 116 of the modified hitting portion 706.

All dimensions and materials used in the preferred embodiment are for convenience purpose only. It would be readily apparent to one of ordinary skill in the relevant arts to design and build a training bat of the present invention using different dimensions, e.g., for a junior size bat, a softball bat, or a standard adult size bat, and to use comparable materials and means for securing the bat together.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined. Thus, the breadth and scope of the present invention should not be limited by any of the above-described exemplary embodiments.

We claim:

1. A training bat, comprising:

a handle portion having a length, a barrel receiving end, and a knob end wherein said handle portion tapers from said barrel receiving end to said knob end;

a hitting portion having a length, a first end, and a second end, said length of said handle portion being longer than said length of said hitting portion;

a tethering means for tethering said second end of said hitting portion to said barrel receiving end of said handle portion such that said second end of said hitting portion is a pre-defined distance from said barrel receiving end of said handle portion and that the training bat is movable between an angled position and an extended position;

wherein said tethering means comprises one or more chain links, a first means for securing a first end of said one or more chain links to said barrel receiving end of said handle portion, and a second means for securing a second end of said one or more chain links to said second end of said hitting portion;

wherein said first means for securing said first end of said one or more chain links to said barrel receiving end of said handle comprises an eye bolt assembly, said eye bolt assembly having a fitting portion of a wood barrel portion secured within said barrel receiving end of said handle portion, said wood barrel portion comprising said hitting portion and said fitting portion, and a first eve bolt secured within said fitting portion of said wood barrel portion such that said first end of said one or more chain links is attached to said first eye bolt; and, wherein said fitting portion is secured within said barrel receiving end of said handle portion by a pin inserted through a hole through said handle portion and said fitting portion, said hole being traverse to a longitudinal axis of said handle portion and in proximity to said barrel receiving end, and said pin having a length equal to about the length of said hole.

2. The training bat according to claim 1, wherein said handle portion is metal.

3. The training bat according to claim 1, wherein said hitting portion is wood.

4. The training bat according to claim 1, wherein said second means for securing is a second eye bolt secured within said second end of said hitting portion such that said second end of said one or more chain links is attached to said second eye bolt.

5. The training bat according to claim 1, wherein said pin is selected from a group consisting of: a locking pin having a male component and a female component, and a roll pin having a first end and a second end, and said further comprising a means for securing said first end of said roll pin and said second end of said roll pin in said hole.

6. The training bat according to claim 1, wherein the pre-defined distance is within the range of about 3 inches to about 4 inches.

7. The training bat according to claim 1, wherein the training bat has a length, and said handle portion is about 54.5% of the length of the training bat, said pre-defined distance is about 10.5% of the length of the training bat, and said hitting portion is about 35% of the length of the training bat.

8. The training bat according to claim 4, wherein said second eye bolt is secured in said hitting portion by extending a threaded portion of said second eye bolt, having a threaded end, through a longitudinal axis of said hitting portion from said second end of said hitting portion to said first end of said hitting portion and by a means for securing said second eye bolt to said hitting portion.

9. The training bat according to claim 8, wherein said means for securing said second eye bolt further comprises a nut.

10. The training bat according to claim 8, wherein said first end of said hitting portion has a depression adapted to receive said threaded end of said second eye bolt and said means for securing said second eye bolt.

11. The training bat according to claim 10, wherein said threaded end of said second eye bolt and said means for securing said second eye bolt do not extend beyond the first end of said hitting portion.

12. A training bat, comprising:

a handle portion having a length, a barrel receiving end, and a knob end wherein said handle portion tapers from said barrel receiving end to said knob end;

a hitting portion having a length, a first end, and a second end, said length of said handle portion being longer than said length of said hitting portion;

a tethering means for tethering said second end of said hitting portion to said barrel receiving end of said handle portion such that said second end of said hitting portion is a pre-defined distance from said barrel receiving end of said handle portion and that the training bat is movable between an angled position and an extended position:

wherein said tethering means comprises one or more chain links, a first means for securing a first end of said one or more chain links to said barrel receiving end of said handle portion, and a second means for securing a second end of said one or more chain links to said second end of said hitting portion:

wherein said first means for securing said first end of said one or more chain links to said barrel receiving end of said handle comprises a link assembly: and, wherein said link assembly comprises a plug, an eye hook having a loop portion and a threaded portion, said threaded portion of said eye hook passing through a hole in said plug, and a means for securing said eye hook to said plug.

13. The training bat according to claim 12, wherein said means for securing said eye hook to said plug is selected from a group consisting of a nut, a cotter pin, liquid epoxy, and a welding means.

14. The training bat according to claim 12, wherein said plug is selected from the group consisting of: a solid plug, a hollow plug, a metal plug, a composite plug, and a wooden plug.

15. The training bat according to claim 12, wherein said link assembly is tack welded within said barrel receiving end of said handle portion.

16. The training bat according to claim 12, wherein the pre-defined distance is within the range of about 3 inches to about 4 inches.

17. The training bat according to claim 12, wherein the training bat has a length, and said handle portion is about 54.5% of the length of the training bat, said pre-defined distance is about 10.5% of the length of the training bat, and said hitting portion is about 35% of the length of the training bat.

18. The training bat according to claim 12, wherein said handle portion is metal.

19. The training bat according to claim 12, wherein said hitting portion is wood.

20. The training bat according to claim 12, wherein said second means for securing is a second eye bolt secured within said second end of said hitting portion such that said second end of said one or more chain links is attached to said second eye bolt.

21. The training bat according to claim 20, wherein said second eye bolt is secured in said hitting portion by extending a threaded portion of said second eye bolt, having a threaded end, through a longitudinal axis of said hitting portion from said second end of said hitting portion to said first end of said hitting portion and by a means for securing said second eye bolt to said hitting portion.

22. The training bat according to claim 21, wherein said means for securing said second eye bolt further comprises a nut.

23. The training bat according to claim 21, wherein said first end of said hitting portion has a depression adapted to receive said threaded end of said second eye bolt and said means for securing said second eye bolt.

24. The training bat according to claim 23, wherein said threaded end of said second eye bolt and said means for securing said second eye bolt do not extend beyond the first end of said hitting portion.

* * * * *